US008523466B2

(12) United States Patent
Mizuguchi et al.

(10) Patent No.: US 8,523,466 B2
(45) Date of Patent: Sep. 3, 2013

(54) IMAGE FORMING APPARATUS

(75) Inventors: Keisuke Mizuguchi, Osaka (JP); Akinori Matsuno, Osaka (JP)

(73) Assignee: Kyocera Mita Corporation (JP)

( * ) Notice: Subject to any disclaimer, the term of this patent is extended or adjusted under 35 U.S.C. 154(b) by 332 days.

(21) Appl. No.: 13/023,978

(22) Filed: Feb. 9, 2011

(65) Prior Publication Data

US 2011/0206441 A1 Aug. 25, 2011

(30) Foreign Application Priority Data

Feb. 24, 2010 (JP) ..... 2010-039299

(51) Int. Cl.
*B41J 13/00* (2006.01)

(52) U.S. Cl.
USPC ..... 400/642; 400/647

(58) Field of Classification Search
USPC ..... 400/642
See application file for complete search history.

(56) References Cited

U.S. PATENT DOCUMENTS

| | | | | |
|---|---|---|---|---|
| 5,018,889 | A * | 5/1991 | Oyaide et al. | 400/642 |
| 5,854,965 | A * | 12/1998 | Kasiwabara et al. | 399/381 |
| 6,145,828 | A * | 11/2000 | Arai | 271/3.03 |
| 7,454,158 | B2 * | 11/2008 | Nakano et al. | 399/121 |
| 7,694,951 | B2 * | 4/2010 | Shiohara | 271/9.08 |
| 7,731,179 | B2 * | 6/2010 | Izuchi et al. | 271/145 |
| 7,778,568 | B2 * | 8/2010 | Sakashita et al. | 399/110 |
| 7,862,030 | B2 * | 1/2011 | Igarashi | 271/10.1 |
| 8,185,016 | B2 * | 5/2012 | Mori et al. | 399/124 |
| 2006/0140669 | A1 * | 6/2006 | Sato | 399/110 |

FOREIGN PATENT DOCUMENTS

| | | |
|---|---|---|
| JP | 7-112848 | 5/1995 |
| JP | 2008105791 | 5/2008 |

* cited by examiner

*Primary Examiner* — Anthony Nguyen
(74) *Attorney, Agent, or Firm* — Gerald E. Hespos; Michael J. Porco; Matthew T. Hespos

(57) ABSTRACT

An image forming apparatus including: a housing configured to accommodating an image forming portion for forming an image on a sheet; and a conveying mechanism configured to at least partially define a conveying path for guiding the sheet to the image forming portion, wherein the conveying mechanism includes a first conveying element including an upstream end on which a feeding assembly for feeding the sheet is formed, and a second conveying element confronting the first conveying element to form the conveying path in cooperation with the first conveying element, and the housing includes a rail configured to guide displacement of the second conveying element from a first position where the second conveying element forms the conveying path along the first conveying element to a second position where the second conveying element is away from the first conveying element.

6 Claims, 12 Drawing Sheets

IMAGE FORMING APPARATUS

BACKGROUND OF THE INVENTION

1. Field of the Invention

The present invention relates to an image forming apparatus with a conveying mechanism configured to preferably clear a paper jam.

2. Description of the Related Art

An image forming apparatus such as a copy machine, a printer, a fax machine or a complex machine with their functions generally conveys a sheet and forms a toner image in the housing. Such an image forming apparatus typically comprising a removal mechanism configured to remove sheets jammed in the housing.

A known removal mechanism includes a sheet feeder and a conveying portion, which are connected with each other by a link mechanism, and allows them to be integrally pulled out from the housing. A user may pull out the sheet feeder and the conveying portion from the housing to remove sheets jammed in the housing.

Since the sheet feeder and the conveying portion of the aforementioned removal mechanism are integrally pulled out from the housing, the user may more efficiently remove the sheets jammed in the housing. The link mechanism integrating the sheet feeder and the conveying portion, however, results in increase in size of the entire image forming apparatus. Moreover, appropriate settings for feeding a sheet is likely to change because the sheet feeder is unnecessarily moved, which results in a failure of the sheet feeding process.

SUMMARY OF THE INVENTION

An object of the present invention is to provide an image forming apparatus which allows efficient removal of a sheet without unnecessarily moving a sheet feeding mechanism configured to feed sheets.

An image forming apparatus having an image forming portion for forming an image on a sheet according to one aspect of the present invention includes: a housing configured to accommodate the image forming portion; and a conveying mechanism configured to at least partially define a conveying path for guiding the sheet to the image forming portion, wherein the conveying mechanism has a first conveying element including an upstream end on which a feeding assembly for feeding the sheet is formed, and a second conveying element confronting the first conveying element to form the conveying path in cooperation with the first conveying element, the housing includes a rail configured to guide the second conveying element, and the rail guides displacement of the second conveying element from a first position where the second conveying element forms the conveying path along the first conveying element to a second position where the second conveying element is away from the first conveying element.

DETAILED DESCRIPTION OF THE PREFERRED EMBODIMENTS

One embodiment of an image forming apparatus is described hereinafter with reference to the accompanying drawings. It should be noted that directional terms such as "upper," "lower," "left" and "right" hereinafter simply aim to clarify the descriptions without limiting a principle of the image forming apparatus. Also, a term "sheet" in the following descriptions means a copy sheet, coated sheet, OHP sheet, cardboard, postcard, tracing paper and other sheet materials subjected to an image forming process. A term "leading edge of a sheet" means a leading edge of the sheet in a sheet conveying direction. Terms "upstream", "downstream" and other similar terms hereinafter mean concepts of "upstream," "downstream" and the like in terms of the sheet conveying direction.

Figure 1:
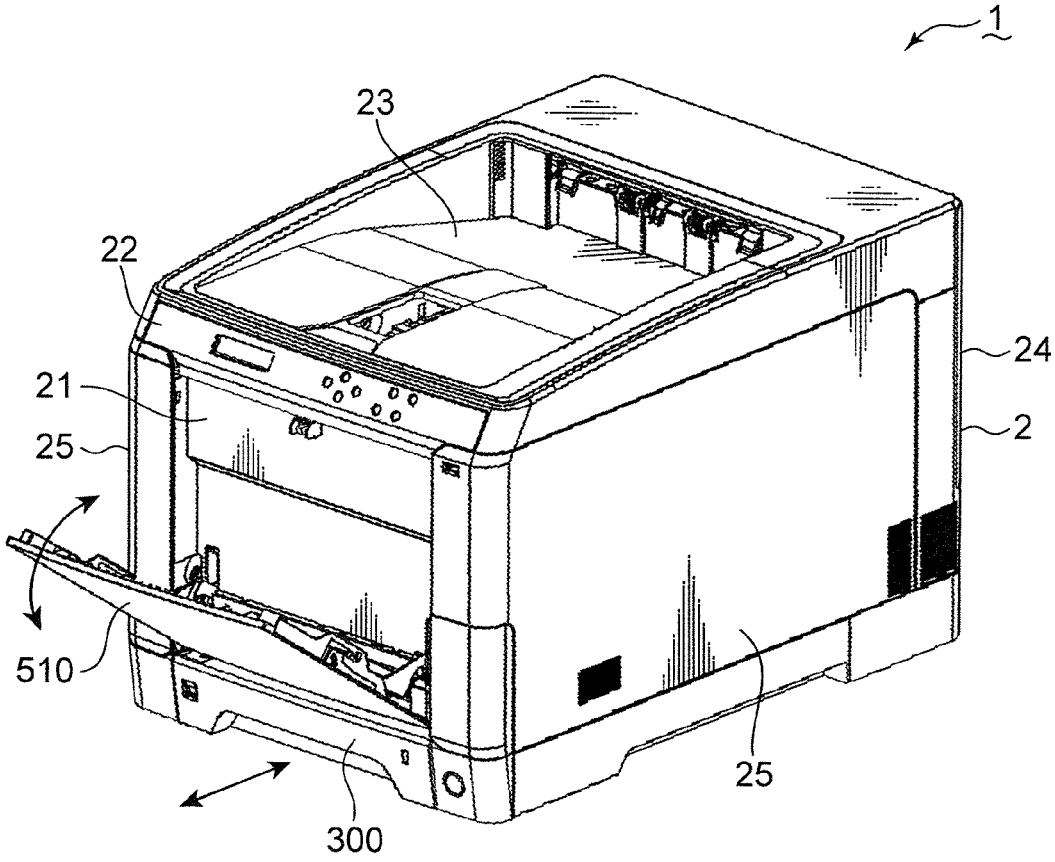
FIG. 1 is a perspective view of an image forming apparatus according to an embodiment.

FIG. 1 is a perspective view showing an appearance of the image forming apparatus according to one embodiment. It should be noted that the image forming apparatus shown in FIG. 1 is a printer. The image forming apparatus may be any other apparatus configured to form an image on a sheet, such as a copy machine, a fax machine or a complex machine with their functions.

An image forming apparatus 1 comprises a substantially rectangular parallelpiped housing 2, a tray 510 protruding from a front side of the housing 2 and a cassette 300 disposed below the tray 510. The housing 2 accommodates various equipments necessary to form an image on a sheet (e.g., various elements used in an image forming portion described hereinafter). The tray 510 attached to the housing 2 turns around a lower edge of the tray 510. The tray 510 shown in FIG. 1 is located in a protruding position so as to protrude from the housing 2. A user may place a sheet on the tray 510 located in the protruding position. A feeding assembly, which is described hereinafter, feeds the sheet on the tray 510 toward the image forming portion configured to form an image on the sheet. When the user turns the tray 510 closer to the housing 2 from the protruding position, the tray 510 becomes accommodated in a concave area 21 formed on the housing 2. The cassette 300 is configured to be inserted into and drawn out from the housing 2. The user may draw out the cassette 300 from the housing 2 toward the front side to place sheets in the cassette 300. After placing desired sheets in the cassette 300, the user may insert the cassette 300 into the housing 2. In the following descriptions, the sheet on the tray 510 is exemplified as a first sheet, and the sheet accommodated in the cassette 300 is exemplified as a second sheet. The image forming apparatus 1 may selectively convey the first sheet and the second sheet to the image forming portion to form a toner image.

An operation panel 22 is disposed above the tray 510. The user may operate the operation panel 22 to perform a desired operation on the image forming apparatus 1. The operation panel 22 may includes a button for adjusting, for example, density of the toner image. The image forming apparatus 1 forms a toner image on a sheet in accordance with an input from the user onto the operation panel 22, as well as an image signal (a signal with information on an image to be printed) sent from an external device (e.g., a personal computer).

After the image forming portion forms a toner image on a sheet fed from the tray 510 or the cassette 300, the sheet is discharged onto a discharge tray 23 formed on an upper surface of the housing 2. The sheet subjected to the image forming process is stacked in a space in the form of a substantially triangular pole, which is formed on an upper surface of the discharge tray 23.

Figure 2:
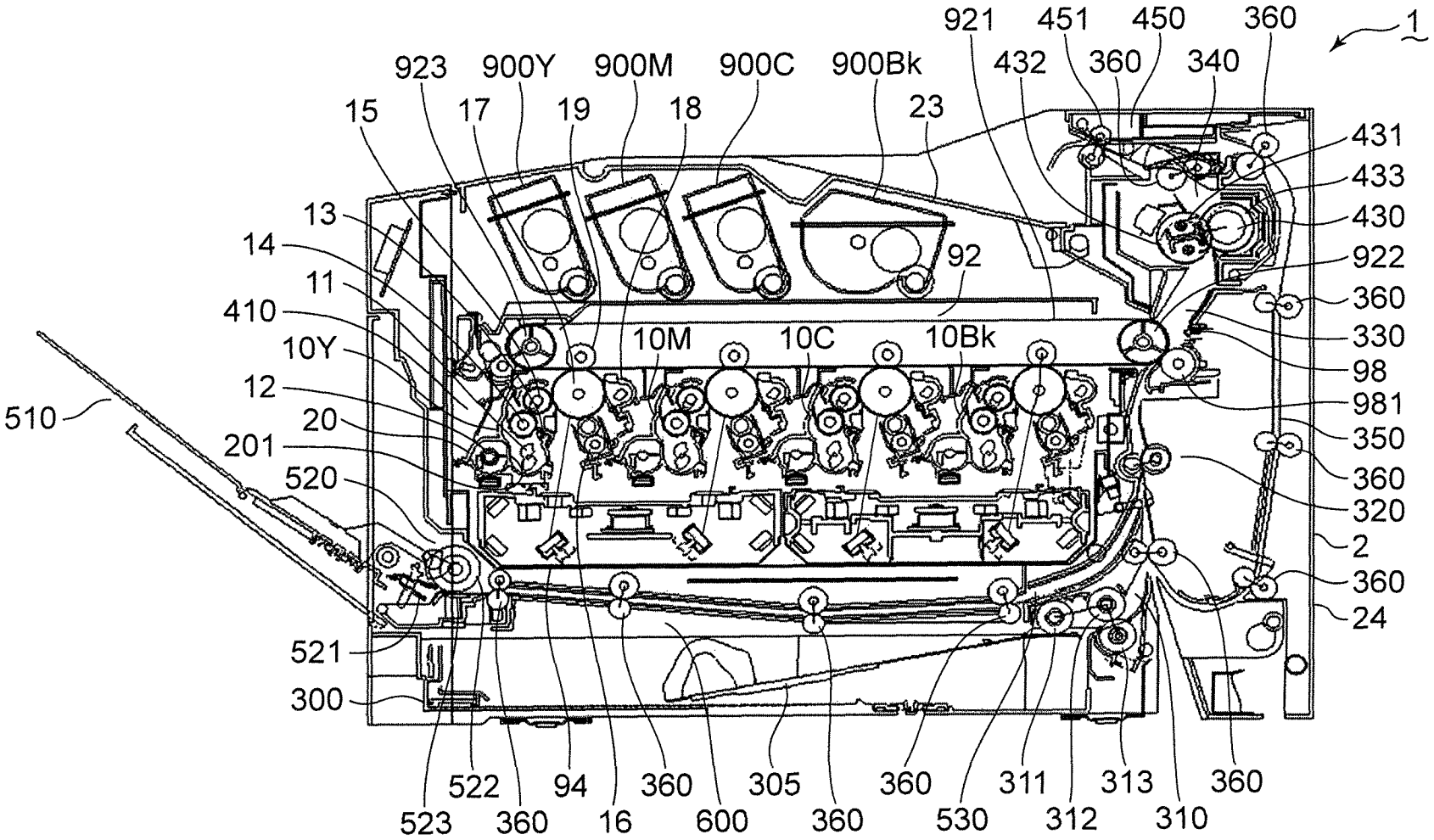
FIG. 2 is a diagram schematically showing an internal structure of the image forming apparatus shown in FIG. 1.

FIG. 2 schematically shows an internal structure of the image forming apparatus 1. The image forming apparatus 1 is further described with reference to FIGS. 1 and 2.

As described above, a sheet is conveyed from the tray 510 or the cassette 300. Subsequently, the sheet is guided by a conveying path formed in the housing 2 and sent to the image forming portion 410. The image forming portion 410 forms the toner image on the sheet. The sheet is then conveyed to a fixing portion 430. The fixing portion 430 fixes the toner image onto the sheet. Thereafter, the sheet is discharged onto the discharge tray 23 through a discharge portion 450.

The conveying path includes a first feed path 530 extending toward a back wall 24 of the housing 2. A feeding assembly 520 configured to pull the first sheet into the housing and feed it to the image forming portion 410 is disposed at an upstream end of the first feed path 530. The conveying path further includes a second feed path 310 extending upward from a downstream end of the cassette 300 (the right end in FIG. 2) located below the first feed path 530. The first feed path 530 and the second feed path 310 join together at an upstream side of a resist roller pair 320 configured to send a sheet to the image forming portion 410 in synchronization with the image forming process performed by the image forming portion 410. A substantially linear section in the first feed path 530 above the cassette 300 is formed by a conveying mechanism 600, which is described hereinafter.

The conveying path further includes a main conveying path 330 for guiding a sheet from the resist roller pair 320 to the fixing portion 430, and a discharge conveying path 340 for guiding the sheet from the fixing portion 430 to the discharge portion 450. The image forming portion 410 forms a toner image on a sheet moving along the main conveying path 330. The fixing portion 430 then fixes the toner image onto the sheet. If a user performs one-side printing using the image forming apparatus 1, the discharge portion 450 discharges the sheet, which is sent from the fixing portion 430 to the discharge conveying path 340, to the outside of the housing 2. The discharged sheet is stacked on the discharge tray 23.

If the user performs both side printing using the image forming apparatus 1, the discharge portion 450 carries out a switchback operation so that a certain length of the sheet sent from the fixing portion 430 to the discharge conveying path 340 is further sent outside the housing 2 and then pulled back into the housing 2. The conveying path further includes a return conveying path 350 for guiding the sheet pulled back by the discharge portion 450. The return conveying path 350 extends toward the back wall 24 of the housing 2 from the discharge portion 450 and then extends downward. Thereafter, the return conveying path 350 extends toward the second feed path 310 and joins together with the second feed path 310.

A conveying roller pair 360 configured to convey a sheet guided by the first feed path 530, the second feed path 310, the main conveying path 330, the discharge conveying path 340 and the return conveying path 350 is disposed in proper places of these conveying paths.

As described above, the feeding assembly 520 sends the first sheet put on the tray 510 to the first feed path 530 formed by the conveying mechanism 600. The feeding assembly 520 comprises a lift plate 521 configured to lift up a leading edge of the first sheet on the tray 510 which is inclined downward towards the housing 2, a feed roller 522 configured to come into contact with the leading edge of the first sheet lifted up by the lift plate 521, and a separating pad 523 disposed below the feed roller 522. When the feed roller 522 rotates, the first sheet passes between the feed roller 522 and the separating pad 523, and is then sent into the first feed path 530. The separating pad 523 applies frictional force to the first sheet passing between the feed roller 522 and the separating pad 523. Therefore, when the feed roller 522 sends several first sheets to the first feed path 530, the separating pad 523 applies frictional force acting in a direction opposite to the conveying direction, to the first sheets other than the top first sheet (the first sheet which is in direct contact with the feed roller 522), to prevent conveyance of these redundant first sheets into the first feed path 530. Consequently the first sheets are sent into the first feed path 530 one by one.

The cassette 300, which is used as another sheet feeding source, includes a lift plate 305 configured to support the second sheet. The lift plate 305 inclines so as to lift up a leading edge of the second sheet in the cassette 300. A pickup roller 311 is disposed above a downstream end of the lift plate 305. The pickup roller 311 comes into contact with the leading edge of the second sheet lifted up by the lift plate 305. Consequently the second sheet is sent from the cassette 300 to the downstream as the pickup roller 311 rotates.

A feed roller 312 and a separating roller 313 below the feed roller 312 are disposed at a downstream position of the pickup roller 311. The pickup roller 311 sends the second sheet between the feed roller 312 and the separating roller 313. The feed roller 312 rotates to send the second sheet further downstream. The separating roller 313, on the other hand, rotates in a direction for returning the second sheet back to the cassette 300. Therefore, when the pickup roller 311 sends several second sheets, the separating roller 313 pulls the second sheets other than the top second sheet (the second sheet which is in direct contact with the feed roller 312) back to the cassette 300. Consequently the second sheets are sent to the second feeding path 310 one by one.

The sheets conveyed to the second feed path 310 are sent toward the resist roller pair 320 by the conveying roller pair 360 provided in the second feed path 310 with which the aforementioned return conveying path 350 joins together at an upstream position of the conveying roller pair 360 in the second feed path 310. Therefore, the conveying roller pair 360 in the second feed path 310 similarly sends the sheets fed to the second feed path 310 via the return conveying path 350, to the resist roller pair 320 as well. The first feed path 530 and the second feed path 310 joins together at the upstream position of the resist roller pair 320. Thus, the resist roller pair 320 feeds the sheets conveyed through the first feed path 530 or the second feed path 310, to the image forming portion 410.

The image forming portion 410 comprises a yellow (Y) toner container 900Y, magenta (M) toner container 900M, cyan (C) toner container 900C, and black (Bk) toner container 900Bk. Developing devices 10Y, 10M, 10C and 10Bk corresponding to the YMCBk are disposed below these containers, respectively. The image forming portion 410 uses the toner contained in these toner containers 900Y, 900M, 900C and 900Bk to form an image on a sheet.

The image forming portion 410 comprises photosensitive drums 17 (photoreceptors on which latent images are formed by electrophotography) configured to bear toner images thereon. Photosensitive drums using amorphous silicon (a-Si) based materials may be used as the photosensitive drums 17. The photosensitive drums 17 are supplied with the yellow, magenta, cyan and black toner from the toner containers 900Y, 900M, 900C and 900Bk, respectively.

A charger 16, the developing device 10 (10Y, 10M, 10C or 10Bk), a transfer roller 19 and a cleaning device 18 are disposed on a circumference of the photosensitive drum 17. The charger 16 uniformly charges the surface of the photosensitive drum 17. An exposure unit 94 exposes the surfaces of the charged photosensitive drums 17 to light to form electrostatic latent images on the photosensitive drums 17, respectively. The exposure unit 94 radiates laser beams based on, for example, image signals (signal with image information) from the external device. The developing devices 10Y, 10M, 10C and 10Bk use the toner supplied by the toner containers 900Y, 900M, 900C and 900Bk, to develop (visualize) the electrostatic latent images formed on the photosensitive drums 17, respectively. The transfer roller 19 and the photosensitive drum 17 sandwich an intermediate transfer belt 921 to form a nip. The transfer roller 19 primarily transfers the toner image formed on the photosensitive drum 17 onto the intermediate transfer belt 921. The cleaning device 18 cleans the circumferential surface of the photosensitive drum 17 after the transfer of the toner image.

The developing devices 10Y, 10M, 10C and 10Bk comprise developing housings 20, respectively. The developing housing 20 may store two-component developer with magnetic carrier and toner. Stirring rollers 11 and 12 are disposed near a bottom of the developing housing 20. The stirring rollers 11 and 12 extending parallel to each other rotate inside the developing housing 20.

A developer circulation path is formed on an inner bottom surface of the developing housing 20. The stirring rollers 11 and 12 are disposed in the circulation path. The developing housing 20 includes a partition 201 disposed between the stirring rollers 11 and 12. The partition 201 stands upright from the bottom of the developing housing 20 to partially partition the circulation path. The circulation path surrounds the partition 201. The two-component developer is stirred by the stirring rollers 11 and 12 and conveyed along the circulation path.

The toner is charged while the stirring rollers 11 and 12 stir and circulate the two-component developer in the developing housing 20. The two-component developer on the stirring roller 11 is attracted by a magnetic roller 14 above the stirring roller 11. The attracted two-component developer forms a magnetic brush (not shown) on the magnetic roller 14. A doctor blade regulates thickness of the magnetic brush. A toner layer is formed on a developing roller 15 by potential difference between the magnetic roller 14 and the developing roller 15. The electrostatic latent image on the photosensitive drum 17 is developed by the toner layer.

The exposure unit 94 comprises various optical equipments such as a light source, a polygon mirror, a reflective mirror and a polarizing mirror. The exposure unit 94 irradiates the circumferential surface of the photosensitive drum 17 provided in the image forming portion 410, with the light based on the image signals to form the electrostatic latent image.

An intermediate transfer unit 92 includes the intermediate transfer belt 921, a driving roller 922 and an idler 923. The toner images formed by the photosensitive drums 17 are superimposed (primarily transferred) to the intermediate transfer belt 921. The superimposed toner images are secondarily transferred by a secondary transfer part 98 to the sheet fed from the cassette 300 or the tray 510. The driving roller 922 and the idler 923 to run the intermediate transfer belt 921 are rotatably supported by the housing 2.

The sheet conveyed from the resist roller pair 320 is sent between the intermediate transfer belt 921 and a transfer roller 981 which configure the secondary transfer part 98. Subsequently, the sheet bearing the toner image transferred by the secondary transfer part 98 is sent to the fixing portion 430.

The fixing portion 430 comprises a heating roller 432 including a built-in heater 431, and a pressure roller 433 compressed to the heating roller 432. The sheet sent from the secondary transfer part 98 is delivered between the heating roller 432 and the pressure roller 433. The toner on the sheet is melted by heat energy from the heating roller 432 and receives pressure from the pressure roller 433. Consequently the toner image is fixed onto the sheet. The fixing portion 430 sends the sheet to the discharge portion 450 through the discharge conveying path 340 after fixing the toner images onto the sheet.

The discharge portion 450 comprises a discharge roller pair 451. The discharge roller pair 451 bi-directionally rotates to accomplish the aforementioned switchback operation.

Figure 3:
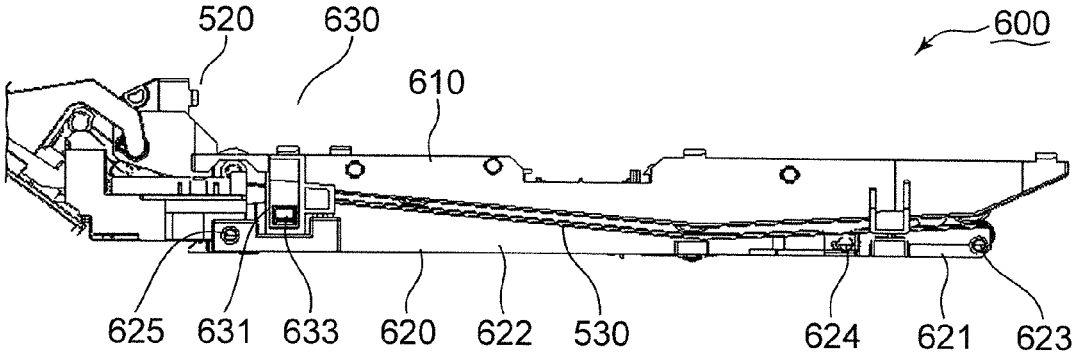
FIG. 3 is a side view showing a conveying mechanism of the image forming apparatus shown in FIG. 2.

FIG. 3 is a side view showing the conveying mechanism 600 forming the first feed path 530. The conveying mechanism 600 is described with reference to FIGS. 2 and 3.

The conveying mechanism 600 comprises a first conveying element 610 and a second conveying element 620 disposed below the first conveying element 610. An upper surface of the second conveying element 620 along a lower surface of the first conveying element 610 at least partially defines the first feed path 530. In the following description, the position of the second conveying element 620 where the upper surface of the second conveying element 620 extends along the lower surface of the first conveying element 610 is exemplified as a first position. The position of the second conveying element 620 farther away from the first conveying element 610 than the first position is exemplified as a second position.

The feeding assembly 520 described in the context of FIG. 2 is formed at an upstream end of the first conveying element 610. As described above, the feeding assembly 520 feeds the sheet to the first feed path 530 formed between the first conveying element 610 and the second conveying element 620.

The second conveying element 620 confronting the first conveying element 610 forms the first feed path 530 in cooperation with the first conveying element 610, as described above. The second conveying element 620 includes an upstream element 622 and a downstream element 621. The upstream element 622 and the downstream element 621 are aligned along a feed direction in which the first sheet is fed from the feeding assembly 520. The upstream element 622 and the downstream element 621 are pivotally connected to each other. FIG. 3 shows a pin 624 configured to pivotally connect the upstream element 622 with the downstream element 621. Instead of the pin 624, an appropriate connecting member configured to pivotally connect the upstream element 622 with the downstream element 621 to each other may be used. A first boss 625 protrudes from a side surface of an upstream end of the upstream element 622. A second boss 623 protrudes from a side surface of a downstream end of the downstream element 621.

Figure 4:
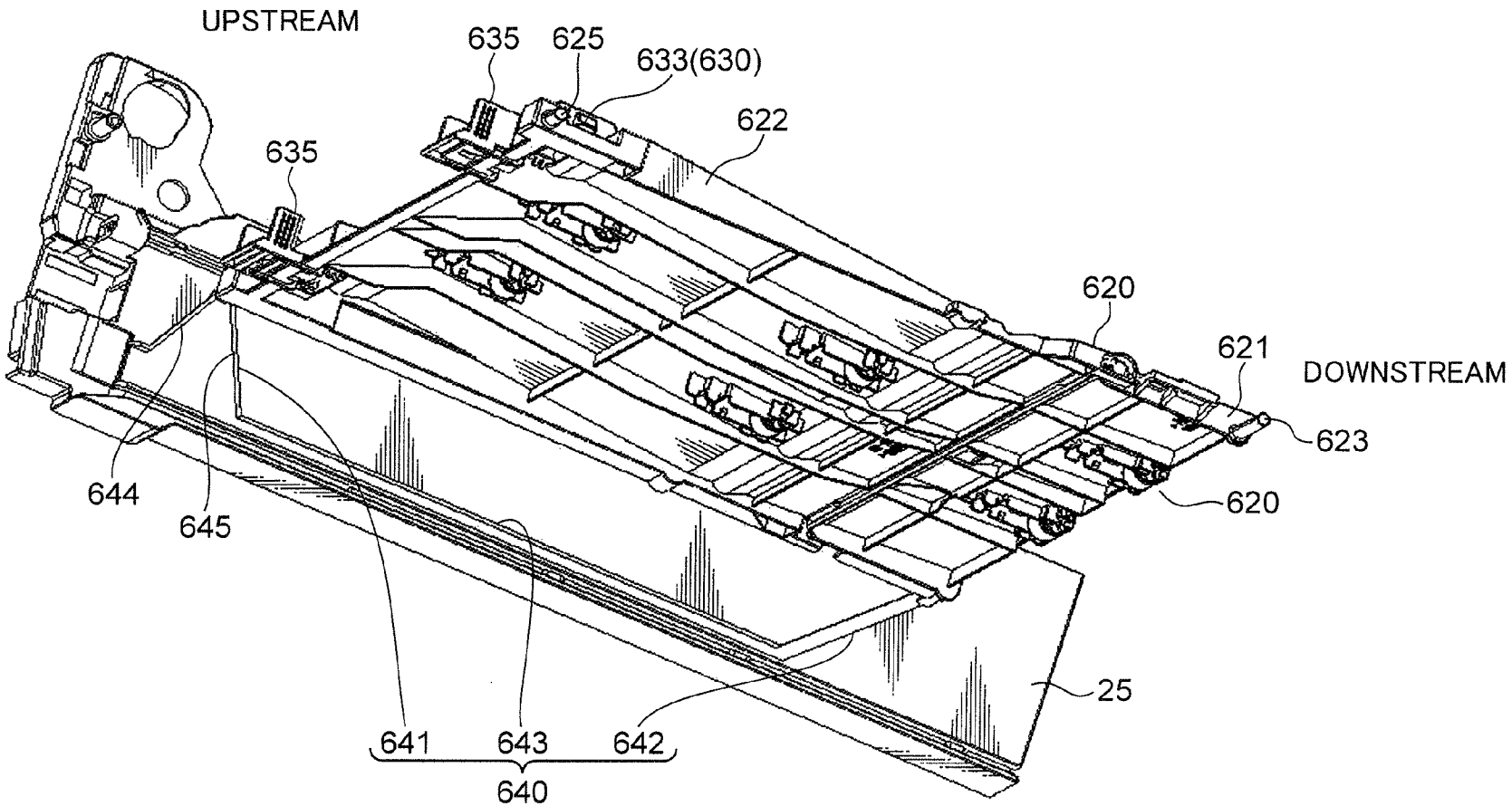
FIG. 4 is a perspective view showing the conveying mechanism of the image forming apparatus shown in FIG. 2.

FIG. 4 is a perspective view of the second conveying element 620 connected to an inner wall of a side wall 25 of the housing 2. The second conveying element 620 shown in FIG. 4 is present in the first position. It should be noted that FIG. 4 shows neither the first conveying element 610 nor the cassette 300. The second conveying element 620 is further described with reference to FIGS. 1 to 4.

Depressed rails 640 are provided in an inner surface of left and right side walls 25 of the housing 2, respectively. The rail 640 includes a first rail 641 configured to engage with the first bosses 625 protruding from left and right side surfaces of the upstream element 622, respectively. The first rail 641 guides the upstream element 622 from the first position to the second position. The rail 640 further includes a second rail 642 configured to engage with the second boss 623 protruding from left and right side surfaces of the downstream element 621, respectively. The second rail 642 guides the downstream element 621 from the first position to the second position. The rail 640 further includes a third rail 643 horizontally extending (a direction in which the cassette 300 is inserted or drawn out). The third rail 643 is connected to lower ends of the first rail 641 and the second rail 642. The third rail 643 may be configured to guide the cassette 300 to be inserted into and drawn out from the housing 2. The second conveying element 620 is guided by the first rail 641 and the second rail 642 and displaced from the first position to the second position. Thereafter, the second conveying element 620 is guided by the third rail 643 and is allowed to move in the direction of the insertion or drawing out of the cassette 300.

The first rail 641 includes an upstream wall 644 inclining in an upstream direction from a point where the first position of the upstream element 622 is defined to a point where the second position is defined, as well as a downstream wall 645 inclining in a downstream direction from a point where the first position of the upstream element 622 is defined to a point where the second position is defined. The second rail 642 inclines in an upstream direction from the point where the first position of the downstream element 621 is defined to a point where the second position is defined along the inclined upstream wall 644 of the first rail 641.

Figure 5:
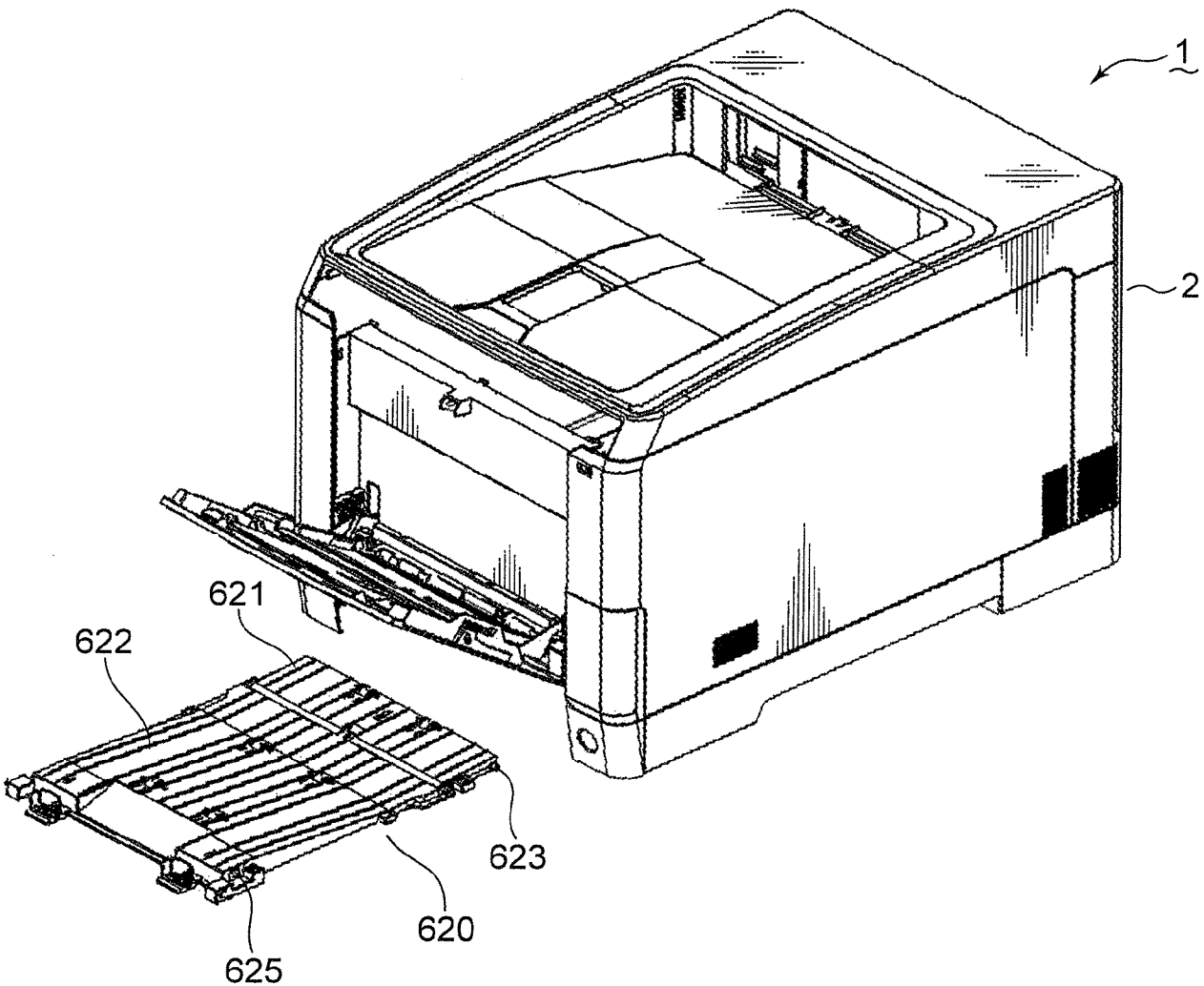
FIG. 5 is a perspective view showing the conveying mechanism completely drawn out from a housing.

FIG. 5 is a perspective view showing the second conveying element 620 completely drawn out from the housing 2 of the image forming apparatus 1. Operations performed on the second conveying element 620 are described with reference to FIG. 1 and FIGS. 3 to 5.

After drawing out the cassette 300 from the housing 2, a user may completely draw out the second conveying element 620 from the housing 2 as shown in FIG. 5. After removing the cassette 300 from the housing 2, the user displaces the second conveying element 620 downward. When the upstream element 622 is displaced from the first position to the second position, the first boss 625 of the upstream element 622 guided by the upstream wall 644 of the first rail 641 is displaced downward while moving in the upstream direction. When the downstream element 621 is displaced from the first position to the second position, the second boss 623 of the downstream element 621 guided by the second rail 642 is displaced downward while moving in the upstream direction, as with the upstream element 622. Subsequently, the user may draw out the second conveying element 620 existing in the second position from the housing 2 along the third rail 643. Consequently sheets jammed in the first feed path 530 formed between the first conveying element 610 and the second conveying element 620 is moved to the outside of the housing 2 along with the second conveying element 620. Alternatively the sheets jammed in the first feed path 530 are dropped into a space for accommodating the cassette 300. Thus the user may efficiently remove the sheets jammed in the first feed path 530.

After removing the sheet jammed in the first feed path 530, the user may push the second conveying element 620 from the downstream element 621 into the housing 2. The downstream element 621 is guided by the third rail 643 to horizontally moves in the housing 2. Thereafter the downstream element 621 forms a corner with the upstream element 622 when the second boss 623 is transferred from a downstream end of the third rail 643 to the second rail 642. After the second boss 623 reaches an upper end of the second rail 642, the user may push the upstream element 622 upward. Consequently the first boss 625 of the upstream element 622 guided by the downstream wall 645 of the first rail 641 moves in the upstream direction while moving upward. When the first boss 625 reaches the upstream end of the first rail 641, upper surfaces of the upstream element 622 and the downstream element 621 become substantially flush with each other. Consequently the second conveying element 620 reaching the first position forms the first feed path 530 in corporation with the first conveying element 610.

Figure 6:
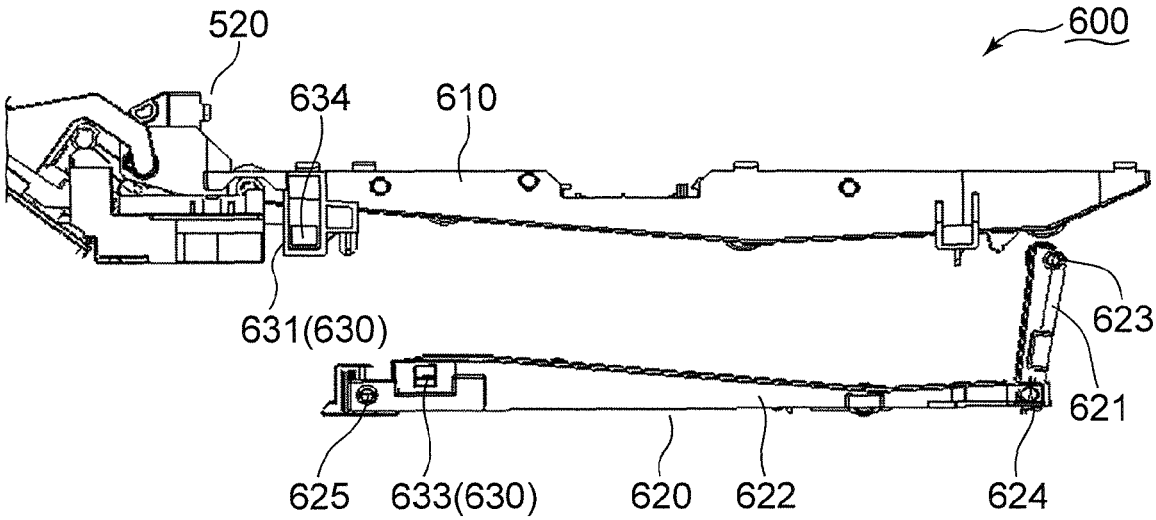
FIG. 6 is a side view showing a positioning mechanism of the conveying mechanism.
Figure 7:
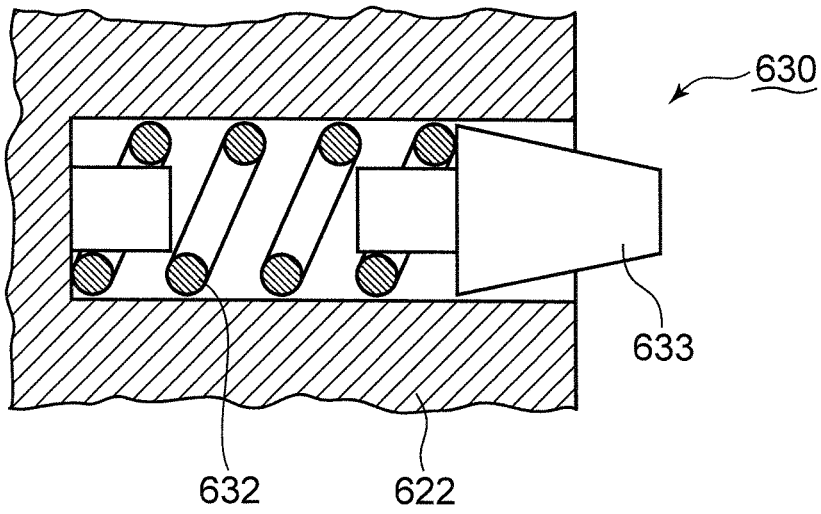
FIG. 7 is a cross-sectional diagram schematically showing the positioning mechanism of the conveying mechanism.

FIG. 6 is a side view of the conveying mechanism 600 for schematically illustrating a positioning mechanism configured to position the second conveying element 620 in the first position. FIG. 7 is a cross-sectional view for schematically illustrating the positioning mechanism configured to position the second conveying element 620 in the first position. The positioning mechanism is described with reference to FIGS. 3, 4, 6 and 7.

The conveying mechanism 600 has a positioning mechanism 630 configured to position the second conveying element 620 in the first position. The positioning mechanism 630 includes a substantially rectangular frame 631 attached to the side surface of the first conveying element 610, a biasing member 632 buried in the upstream element 622, and an engaging piece 633 attached to a tip of the biasing member 632. An engaging hole 634 is formed in the frame 631. In the present embodiment, a coil spring is used as the biasing member 632. Alternatively, any member configured to protrude and retract the engaging piece 633 with respect to a side surface of the upstream element 622 may be used as the biasing member 632.

When the downstream element 621 is in the first position, the upstream element 622 is disposed in the position where the upstream element 622 extends along the first conveying element 610 as described above. At this moment, the engaging piece 633 of the positioning mechanism 630 is inserted into the engaging hole 634. Consequently the upstream element 622 and the downstream element 621 are positioned with respect to the first conveying element 610 and fixed at the first position.

When the user applies downward force to a handle 635 formed at an upstream edge of the upstream element 622, the engaging piece 633 becomes buried in the upstream element 622, so that the engaging piece 633 is disengaged from the engaging hole 634. Thus the user may more easily form a space between the first conveying element 610 and the second conveying element 620. Therefore, the sheets jammed in the conveying mechanism 600 may be easily removed.

Figure 8:
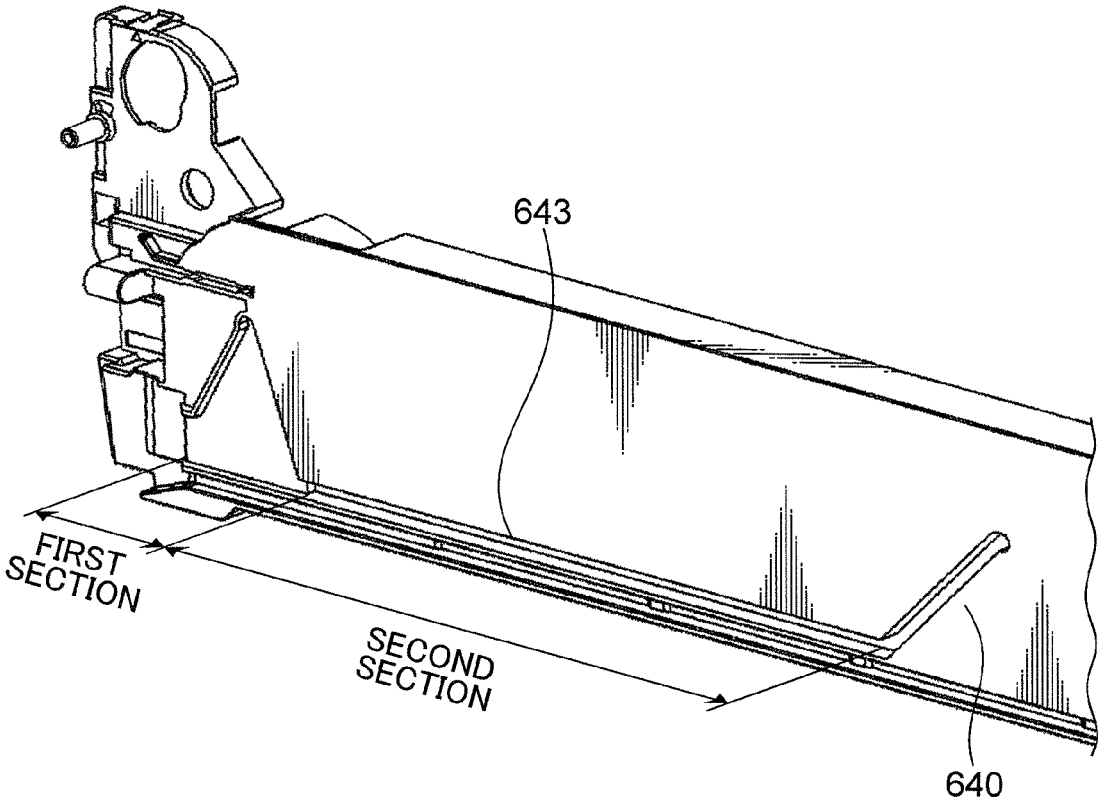
FIG. 8 is a perspective view showing another structure of a rail.

FIG. 8 is a perspective view showing another structure of the rail 640. It should be noted in the embodiment described hereinafter that the structure of the conveying mechanism 600 is substantially similar to the one described in the context of FIGS. 3 to 7. The rail 640 is described with reference to FIGS. 4 and 8.

The third rail 643 of the rail 640 shown in FIG. 8 is divided into an upstream first section and a downstream second section. The first section is used for guiding the first boss 625 of the upstream element 622. The second section is used for guiding the second boss 623 of the downstream element 621. It should be noted in the present embodiment that engagement between the second boss 623 and the third rail 643 is deeper than engagement between the first boss 625 and the third rail 643.

Figure 9:
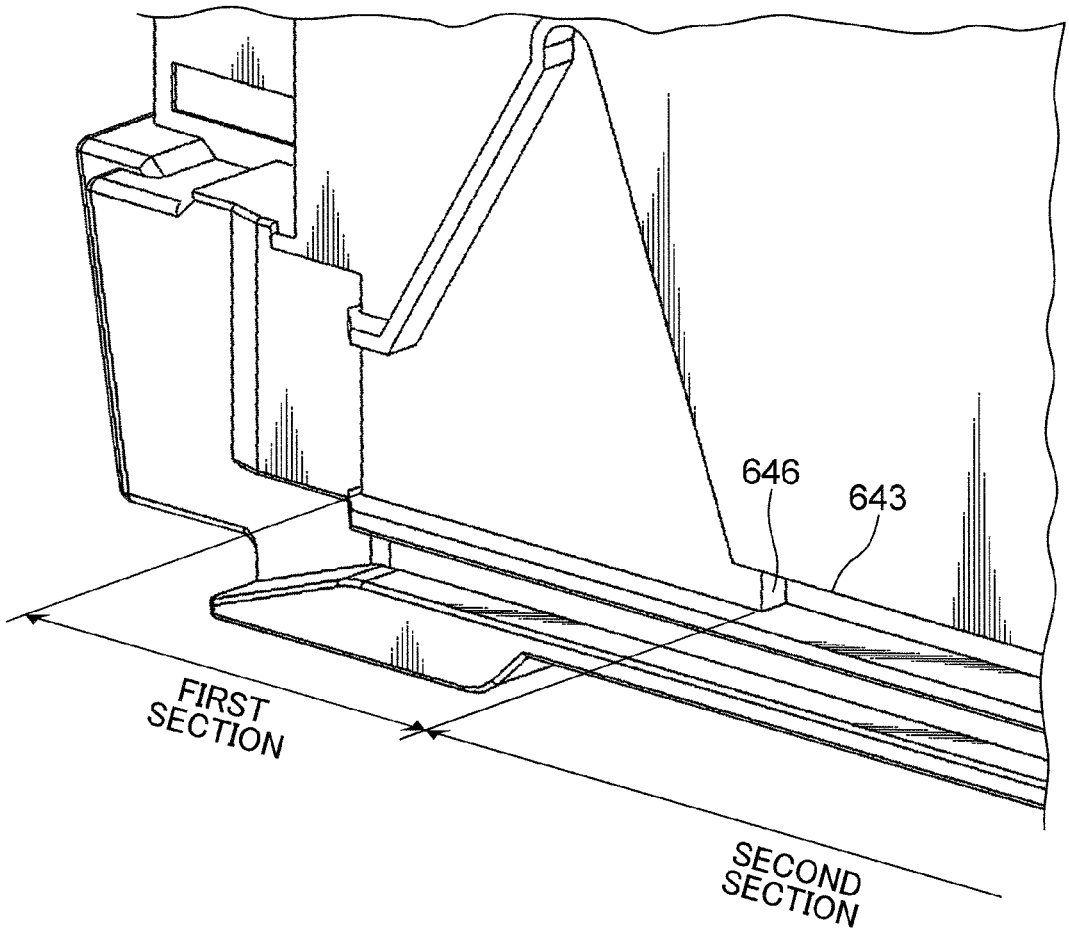
FIG. 9 is an enlarged perspective view around a border between a first section and second section of a third rail.

FIG. 9 is an enlarged perspective view around a border between the first section and the second section. The third rail 643 is further described with reference to FIGS. 4, 8 and 9.

As shown in FIG. 9, the second section of the third rail 643 may be formed deeper than the first section of the third rail 643. Consequently a confining portion 646 configured to confine movement of the second boss 623 toward the first section is formed between the first section and the second section. Alternatively, any structure, shape or size for confining the movement of the second boss 623 such as a wall crossing the third rail 643, a protrusion protruding inward of the third rail 643, and a part where the width of the third rail 643 is reduced, may be used as the confining portion 646.

Figure 10:
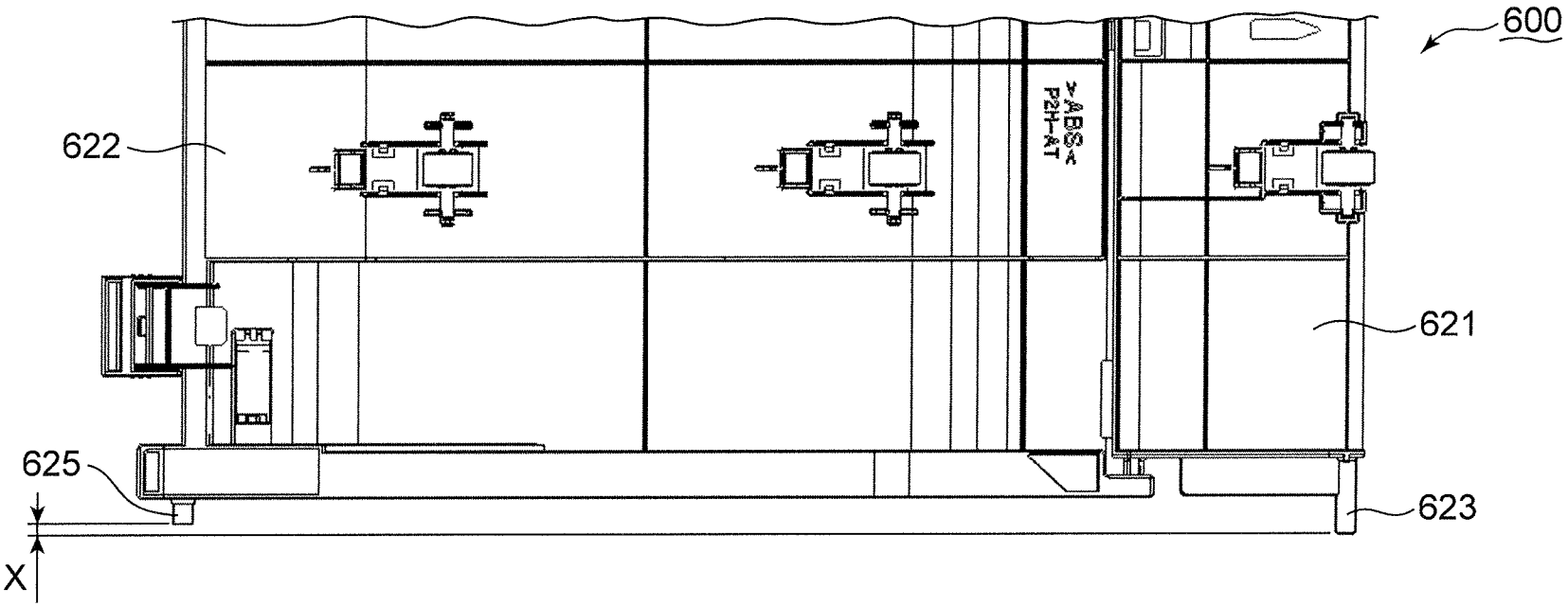
FIG. 10 is a bottom view of the conveying mechanism guided by the rail shown in FIG. 8.

FIG. 10 is a bottom view of the second conveying element 620 guided by the rail 640 described in the context of FIGS. 8 and 9. The second conveying element 620 is described with reference to FIGS. 8 to 10.

As shown in FIG. 10, the second boss 623 protruding from the side surface of the downstream element 621 is longer than the first boss 625 protruding from the side surface of the upstream element 622. The difference X in protrusion amount between the first boss 625 and the second boss 623 protruding from the side surface of the second conveying element 620 is substantially equal to the difference in depth between the first section and the second section of the third rail 643.

Figure 11:
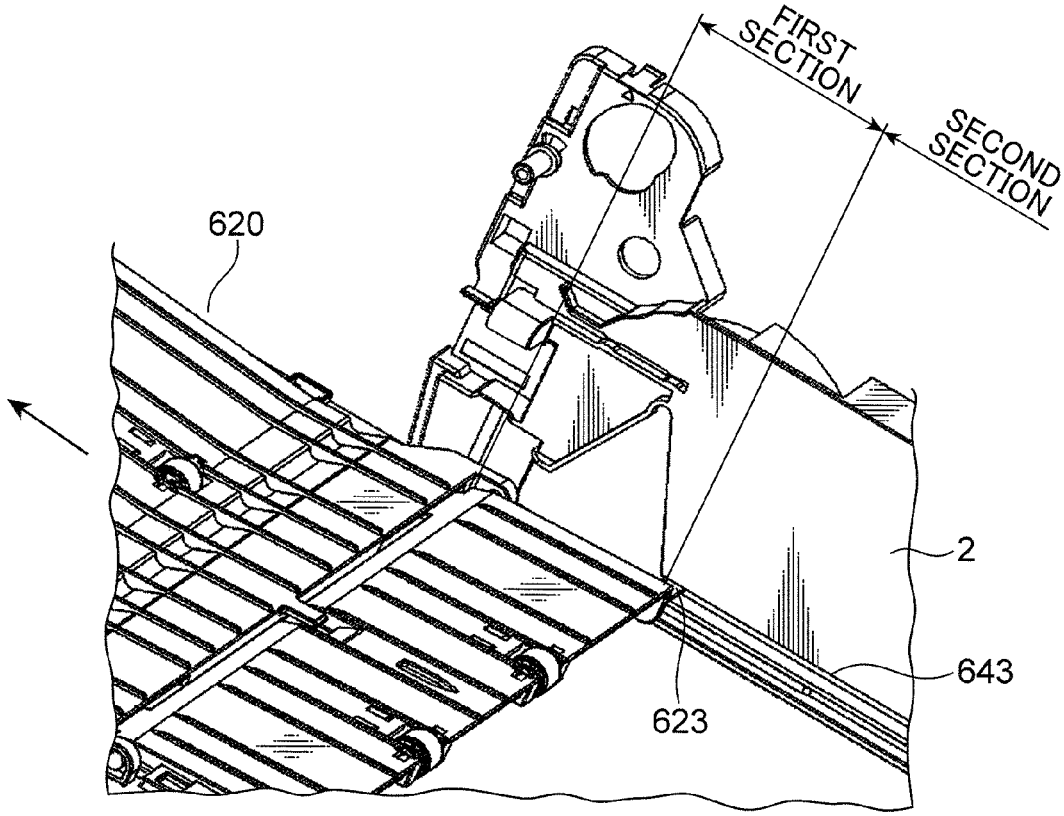
FIG. 11 is a perspective view of the conveying mechanism drawn out from the housing.

FIG. 11 is a perspective view showing the second conveying element 620 drawn out from the housing 2. The movement of the second conveying element 620 is described with reference to FIGS. 8 to 11.

The second boss 623 moves from the second section toward the first section when a user draws out the second conveying element 620 from the housing 2 along the third rail 643. When the second boss 623 reaches the upstream end of the second section, the second boss 623 becomes stuck at the confining portion 646. Consequently the movement of the second conveying element 620 is confined. Thus the second conveying element 620 is partially drawn out from the housing 2.

Figure 12:
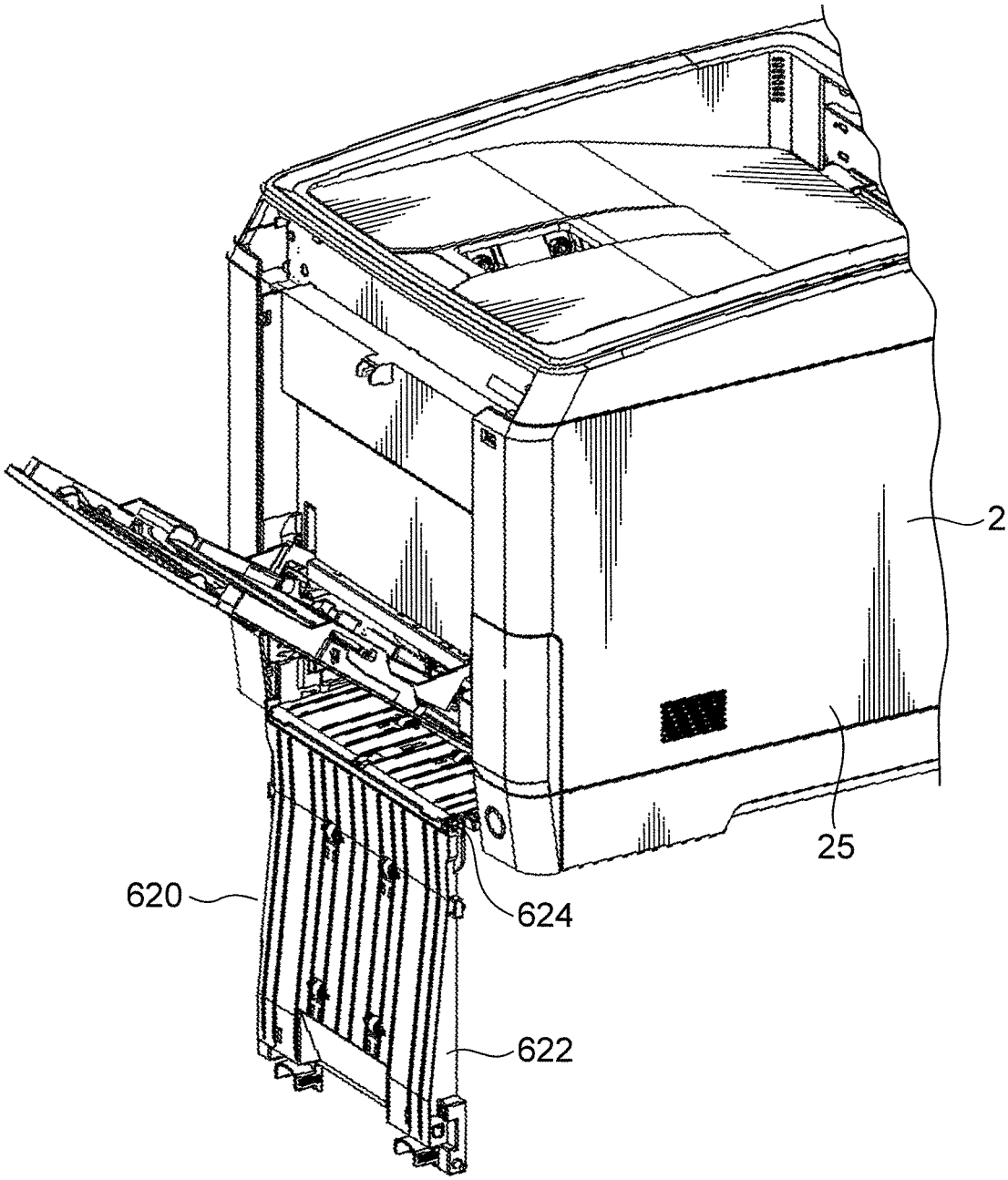
FIG. 12 is a perspective view of the conveying mechanism drawn out from the housing.

FIG. 12 is a perspective view showing the second conveying element 620 partially drawn out from the housing 2. The second conveying element 620 is described with reference to FIGS. 8 to 12.

The upstream element 622 of the second conveying element 620 partially drawn out from the housing 2, because of its weight, turns downward around the pin 624 exposed outside the housing 2. Consequently a user may remove the sheets jammed in the housing 2 without interference with the upstream element 622. Moreover, since the upstream element 622 does not protrude from the housing 2, preferably, the user is less likely to apply excessive load to the second conveying element 620.

As shown in FIG. 12, the downstream element 621 stays in the housing 2. Therefore, after removing the sheet inside the housing 2, the user may guide the second conveying element 620 to the third rail 643 so that the user places the second conveying element 620 into the housing 2. Subsequently, the second conveying element 620 is guided by the first rail 641 and the second rail 642 and installed in the first position. The second conveying element 620 is then positioned by the positioning mechanism 630.

In the present embodiment, the user may remove sheets from the front surface of the housing 2 as shown in FIG. 12. The left and right side walls 25 of the housing 2 may open. In this case, the user may remove the sheets from the lateral side of the conveying mechanism 600.

The embodiment described above creates a sufficiently wide space between the first conveying element 610 and the second conveying element 620 in order to remove sheets. No complicated link mechanism is interposed between the first conveying element 610 and the second conveying element 620. The third rail 643 guides not only the movement of the cassette 300 but also the movement of the second conveying element 620. For this reason, no additional element for guiding the second conveying element 620 is required. Therefore, a smaller image forming apparatus is provided. In addition, since the feeding assembly 520 is not unnecessarily moved, the sheet feed settings is less likely to be changed, so that a failure in feeding the sheets is less likely to occur after removal of the sheets, which results in efficient sheet removal.

This application is based on Japanese Patent application serial No. 2010-039299 filed in Japan Patent Office on Feb. 24, 2010, the contents of which are hereby incorporated by reference.

Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

What is claimed is:

1. An image forming apparatus having an image forming portion for forming an image on a sheet comprising:

a housing configured to accommodate the image forming portion;

a cassette configured to be inserted into and drawn out from the housing; and a conveying mechanism configured to at least partially define a conveying path for guiding the sheet to the image forming portion, wherein the conveying mechanism has a first conveying element including an upstream end on which a feeding assembly for feeding the sheet is formed, and a second conveying element confronting the first conveying element to form the conveying path in cooperation with the first conveying element, the second conveying element includes an upstream element extending along a sheet feed direction, and a pivotal downstream element connected to the upstream element, the housing includes a rail configured to guide the second conveying element from a first position where the second conveying element forms the conveying path along the first conveying element to a second position where the second conveying element is away from the first conveying element, the rail includes a first rail configured to guide the upstream element when the second conveying element is displaced from the first position to the second position, a second rail configured to guide the downstream element when the second conveying element is displaced from the first position to the second position, and a third rail configured to guide the cassette to be inserted and drawn out, the first rail and the second rail join together with the third rail, and the second conveying element located in the second position is configured to be guided by the third rail to move in a direction where the cassette is inserted and drawn out.

2. The image forming apparatus according to claim 1, wherein the first rail includes an upstream wall inclining in an upstream direction from the first position to the second position, and a downstream wall inclining in a downstream direction from the first position to the second position, and the upstream element includes a first boss guided by the first rail.

3. The image forming apparatus according to claim 2, wherein the second rail extending from the first position toward the second position inclines along the inclined upstream wall, and the downstream element includes a second boss guided by the second rail.

4. The image forming apparatus according to claim 3, wherein the third rail includes a first section configured to guide the first boss, a second section configured to guide the second boss, and a confining portion formed between the first section and the second section, and the confining portion confines movement of the second boss toward the first section.

5. The image forming apparatus according to claim 3, further comprising a positioning mechanism configured to position the upstream element of the second conveying element existing in the first position.

6. The image forming apparatus according to claim 5, wherein the positioning mechanism includes:

an engaging hole formed in the first conveying element;

an engaging piece retractably attached to the upstream element, the engaging piece coming into engagement with the engaging hole; and a biasing member configured to bias and protrude the engaging piece from the upstream element.

* * * * *